US005516115A

United States Patent [19]

McLain

[11] Patent Number: 5,516,115

[45] Date of Patent: May 14, 1996

[54] PORTABLE BALL PRACTICE TARGET

[76] Inventor: Timothy J. McLain, 2205 Madison Ct., Woodbridge, Va. 22191

[21] Appl. No.: 362,957

[22] Filed: Dec. 23, 1994

[51] Int. Cl.[6] ..... A63B 69/00; A63B 63/00

[52] U.S. Cl. ..... 273/401; 273/26 A; 273/348; 273/400

[58] Field of Search ..... 273/26 A, 29 A, 273/29 B, 181 F, 317, 398–402, 410, 411, 127 R, 127 B

[56] References Cited

U.S. PATENT DOCUMENTS

| | | | |
|---|---|---|---|
| D. 237,808 | 11/1975 | Ekstrand . | |
| 1,043,308 | 11/1912 | Everson . | |
| 1,511,430 | 10/1924 | Schonberg . | |
| 2,254,986 | 9/1941 | Ziel . | |
| 2,895,727 | 7/1959 | Blees . | |
| 4,718,668 | 1/1988 | Schipske . | |
| 4,836,542 | 6/1989 | Crawley . | |
| 4,886,267 | 12/1989 | Cicciardi et al. | 273/26 A |
| 5,002,274 | 3/1991 | Didema | 273/26 A |
| 5,217,230 | 6/1993 | Judd | 273/400 |
| 5,333,856 | 8/1994 | Gery . | |
| 5,351,948 | 10/1994 | Thomas . | |
| 5,452,896 | 9/1995 | Core | 273/26 A |

FOREIGN PATENT DOCUMENTS

| | | | |
|---|---|---|---|
| 1506395 | 4/1978 | United Kingdom | 273/181 F |

OTHER PUBLICATIONS

Osborne–Osborne Innovative Products Inc., 1994 Catalog of Baseball Equipment pp. 4–7, 10, 13, 16, 17, 30 and 31.

Ateco–Athletic Training Equipment Co., 1994–Baseball and Softball Equipment Catalog, pp. 10, 14 and 19.

*Primary Examiner*—Mark S. Graham

*Attorney, Agent, or Firm*—Clyde I. Coughenour

[57] ABSTRACT

A portable practice target, for propelled balls, includes a light-weight plastic tubing and fittings framework that supports a front and a rear panel in an essentially vertical position. Three edges of the panels are attached together so that the panels fit over the vertical support like a sock or pillow case. The front panel can have a central pocket and the rear panel can have a central opening so that when the panels are positioned over the vertical support, the front panel pocket can be threaded through the rear panel opening. Adjustable strips can be used as a target area and means for adjusting the size of the pocket opening. The framework vertical support can be held in place by angled or adjustable couplings that permit the angle between the horizontal plane and the panels to be adjusted. The panels can be made resilient and elastic to rebound any ball that does not enter the pocket.

20 Claims, 2 Drawing Sheets

PORTABLE BALL PRACTICE TARGET

BACKGROUND OF THE INVENTION

1. Field of the Invention

A portable unit is disclosed, for practice with a ball, having a light-weight frame over which a net is slipped. The net can have a rear panel section with an opening and a front panel section with a pocket with the panels secured along three edges. Using the open end, the net is slipped over the frame in a sock or pillowcase-like manner after which the pocket is threaded through the opening.

2. Description of the Related Art

Pitching practice, golf ball targets, tennis training, football kicking practice and other ball devices are in common use. The patents, U.S. Pat. No. 1,043,308, issued Nov. 5, 1912, to A. G. Everson, and U.S. Pat. No. 5,333,856, issued Aug. 2, 1994, to J. S. Gery, are examples of these devices having pockets provided in netting. Netting has been provided with indicia for indication of ball control and simulation of actual game conditions with U.S. Pat. No. 1,511,430, issued Oct. 14, 1924, and U.S. Pat. No. 2,254,986 issued Sep. 2, 1941, to M. Ziel, examples. Adjustable target sizes have been taught in U.S. Pat. No. 5,333,856 (cited above) and by U.S. Pat. No. 5,351,948, issued Oct. 4, 1994, to R. J. Thomas. Various materials can be used for the netting. Portable frames have also been used, with U.S. Pat. No. 4,718,668, issued Jan. 12, 1988, to D. Schipske and U.S. Pat. No. 4,836,542, issued Jun. 6, 1989 to M. J. Crawley, examples. It has been taught that these frames can be made of plastic and permanently or removably assembled., U.S. Pat. No. 4,836,542 and U.S. Pat. No. 5,351,948 (cited above). It is known that hollow frames can be filled with water or other material for stability, U.S. Pat. No. 4,718,668 (cited above).

SUMMARY OF THE INVENTION

The invention is to a practice target device for thrown, hit or kicked balls. The device improves on practice devices of the prior art by using a construction configuration that is easily assembled and disassembled. The frame is constructed from light-weight plastic that is easily press fit together for easy assembly and disassembly. The panels or netting are of a unitary construction with front and back panels integral or attached along three edges so that the panels can be slid onto and off of a vertical support means like a sock or pillow case. The front panel can be provided with a centrally located pocket and the back panel can be provided with a centrally located opening so that the pocket can be threaded through the opening when the panels are slipped over the target device vertical support means. The front or both panels can be made elastic or resilient to rebound any ball that does not enter the pocket. The vertical support means can utilize angular or adjustable fittings so that the angle the panels are held in can be adjusted to be essentially perpendicular to the trajectory of the ball. The vertical support means can be sloped forwardly, for example to be perpendicular to an upwardly kicked ball, and sloped backwardly, for example to be perpendicular to a ball falling downwardly due to gravitational attraction.

DESCRIPTION OF THE PREFERRED EMBODIMENTS

Figure 1:
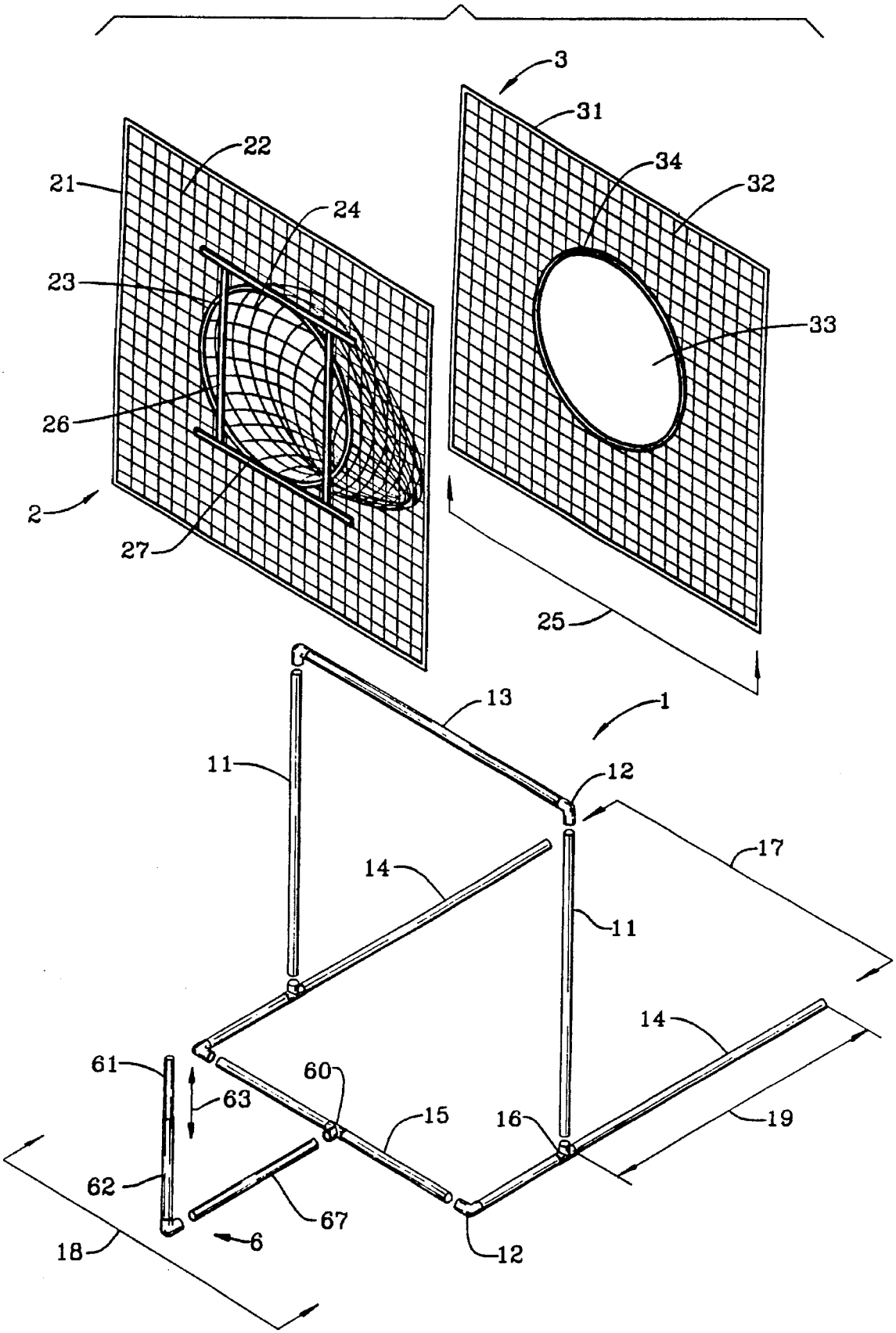
FIG. 1 is a partially exploded perspective view of the practice target framework and front and rear practice target panels.
Figure 2:
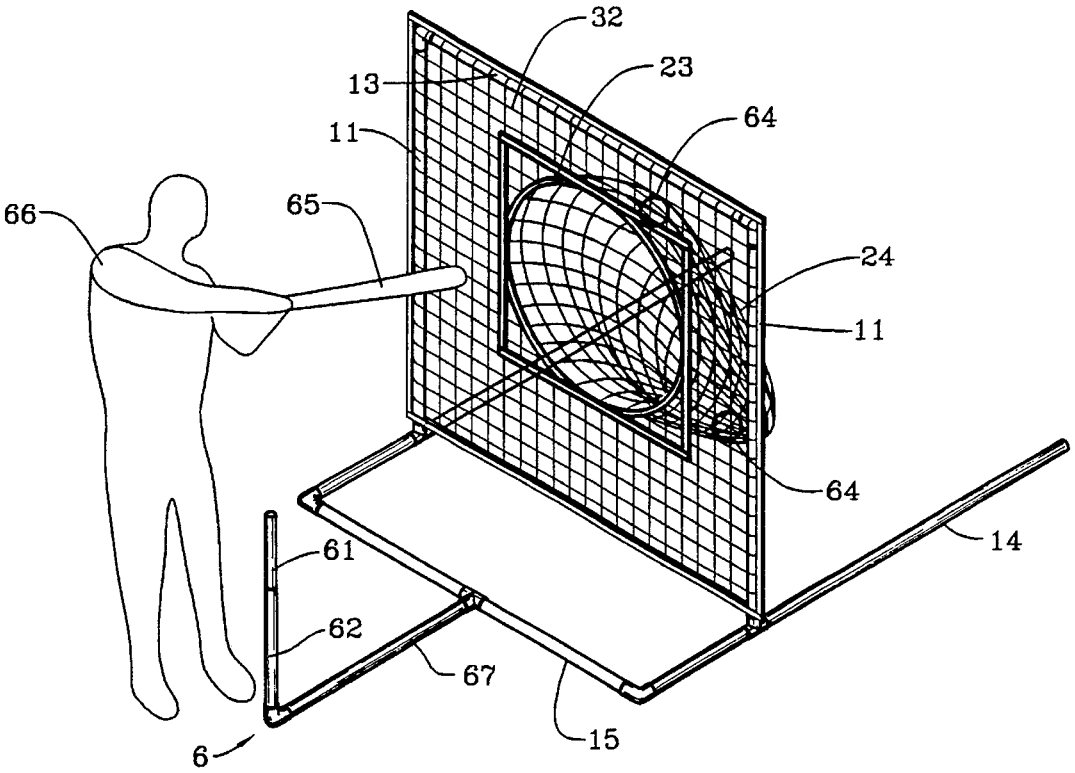
FIG. 2 is a front-side perspective view of the practice target assembled and in use.

The preferred embodiment, as shown in FIGS. 1 and 2, includes a framework made of light-weight plastic tubing and fittings that are easily assembled and disassembled by press fit and netting panels that can have a front panel with a centrally located pocket and a rear panel that can have a centrally located opening. Three sides of the panels are secured together so that the panels fit over the vertical framework support like a sock or pillow case after which the pocket of the front panel is threaded through the opening in the rear panel.

FIG. 1 shows the framework 1 for the device having a base consisting of front base transverse support 15 in front 18 of vertical supports 11 that support a transverse upper horizontal support 13 with a back 17 base support means 14 extending behind the vertical supports 11 and a front panel or net 2 and a rear panel or net 3. The horizontal, transverse upper support 13, and vertical supports 11, and the front base support are secured together with 90 degree elbow connectors 12. The vertical supports 11 are secured to the base using tee connectors 16. The base members 14 and/or 15 can be filled with water or a solid material for additional stability of the unit against wind or ball impact.

The framework 1 is preferably formed of light-weight plastic plumbing-type materials. The parts are preferably press fit together so that they form a stable rigid framework that can be removed for compact and easy shipment. The frame can be made from Schedule 80 or 40 Polyvinyl chloride (PVC) pipe and associated fittings, for example. Select fittings can be chemically welded to the linear supports. In FIG. 1, the fittings shown joined together with pipes or linear supports are those that can be chemically welded together. This chemical welding of pipes and fittings results in the framework having six essential sections that can readily be assembled and disassembled. With this arrangement no clamps or clips or tools or hardware are required for assembly. Pressing the sections together forms a tight fit. During use the flexing of the pipes tends to strengthen or tighten the pressed fits. It has been found that as long as the target's vertical support does not extend beyond 7 feet, a brace is not necessary for use with relatively light-weight balls, such as baseballs, softballs, golf balls, etc.

A base safety zone 19 is formed by having the back base supports 14 extend behind the vertical supports 11 a distance equal to or greater than the length of the pocket 24. By this arrangement a person that stays beyond the base supports 14 will not be in danger of having a ball project the pocket far enough to hit the person.

As shown in FIGS. 1 and 2, the target frame front base support 15 can be provided with a fitting, such as a tee ball support fitting 60, that can attach a forward extension and ball support 6. The ball support includes a forward extension horizontal pipe 67 with a vertical rise pipe 62 that is attachable to the extension horizontal pipe 67 with a 90 degree elbow. The vertical rise pipe 63 adjustably telescopically receives a resilient or rubber tube 61 that can support a ball 64.

The front panel 2 includes a flexible section or netting of the type disclosed in the prior art, such as canvas, nylon, gut, cord, string or fishnet. The netting need not have a pocket, but one is preferred. The netting 22 is shown having an internal section removed and replaced by a pocket 24. The pocket is shown attached to the netting by a pocket binding 23. The pocket can be of the same material as the netting or of a different material, but it is elongated so as to be able to stop and provide a collecting place for balls propelled at the target. The netting 22 is shown with a front panel binding 21 that secures and protects the edges of the netting.

The rear panel 3 is also shown as a netting or panel 32 that can be of the same material as the front panel. The rear panel 3 can have a central section removed to form a rear panel opening 33. Both the netting opening and edges can be provided with restraining and protecting means in the form of a rear panel binding 31 and rear opening binding 34. While the top and side edges of the front and rear panels can be formed integral, it is preferred that they be attached together along three edges, top and sides, with the bottom 25 left open. The front and back panels, attached along three edges, form a stocking or pillowcase-like configuration. The two panels work together to stop or repel a ball that impacts against them.

For use, the frame is secured together and the front and back panels are slipped over the vertical supports means 11,13 with the front panel 2 facing the front 18 of the frame and the rear panel 3 facing the back 17 of the frame. The pocket 24 of the front panel 2 is then pulled through the rear panel opening 33. The target device is now assembled in a condition for use as a ball target. The net or panels can be assembled and removed as easily as a pillowcase can be placed over a pillow. No straps or fasteners are necessary to hold the net or panels in place.

The front and rear panels can be designed to absorb the shock of ball impact so as to have no rebound. As an alternative, the front panel 2, or front panel 2 and rear panel 3, netting 22, or 22 and 32, can be made resilient by stretching them tight and/or by making them from an elastic material. With this construction, a ball that does not enter the pocket can be resiliently repelled back or returned in the direction from which it came.

The netting or panel background can have a strike zone or target woven into the net or panel. Bright or colored materials that contrast with the netting and background can be used. Alternatively, in view of the relatively large area of space not occupied by the strands of the netting of most materials used, removable-type strips can be placed on the front face and rear face of the target front panel or across both the front and back panel to identify a particular zone, such as a strike zone. Pressure-sensitive adhesive, snap fasteners, etc., can be used. A hook-loop type fastening means is preferred. With the hook and loop type strips, for example, the target area can be easily adjusted at will by the user of the device. The strip pairs can be placed one in front and the other behind the panel or net, and can be used to adjust the size of the pocket exposed to the user of the device. That is, the strips can be used to clamp a portion of the pocket so as to present a planar continuation of the front panel 22 in the areas of the pocket 24 that extend between the strips and the target front panel 22. In FIG. 1, horizontal strips 27 and vertical strips 26 are shown that can provide a clamping means and an adjustable target area.

FIG. 2 shows the practice target device assembled and in use. The framework base, front base support 15 and back base support 14, support the upper vertical 11 and upper horizontal 13 support means. The front and back panels are in place with the back panel 32 having the pocket 24 extending rearwardly through the opening 33 in the rear panel. A person 66 is shown after swinging the bat 65 to hit a ball 64 off of a ball support 6. The ball 64 is shown impacting in the pocket 24 with additional balls collected in the bottom of the pocket.

Figure 3:
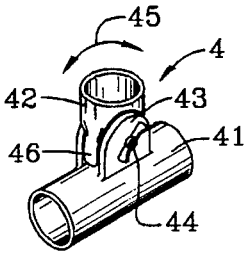
FIG. 3 is a perspective view of an adjustable coupling.

FIG. 3 shows an adjustable alternate coupling in the form of a tee section. The tee 4 shown is a coupling having an adjustable upper leg 42. While any type pivoting means can be used, the upper leg 42 is shown having a lower disc-like extension 46 relatively rotatable between two similar disc-like extensions 43 in the upper portion of the tee 41. A wing nut 44 clamps the relatively rotatable disc-like extensions 43,46 together at a selected angle. The engaging faces of the relatively rotatable disc-like extensions 43,46 can be provided with matching radial projections and indentations for added holding power in the selected clamped position. With this adjustable coupling 4, the frame 1 can be broken down into individual components for compact shipping, or the net left on the uprights 11,13, with the upright frame pivoted down to the back base support to provide an essentially planar configuration for quick and easy storage. With this adjustable coupling, during use, the upright frame 11,13 can be angled downwardly toward the front 18 of the device base 15 support, for use with a golf ball or kicked football or soccer ball, or positioned perpendicular to the base support 14,15, for baseball or softball or golf ball or tennis ball use, or angled backwardly toward the base back support 14 of the device, for use with a basketball or other arched type ball that is thrown or kicked or hit and returned downwardly by gravity.

Figure 4:
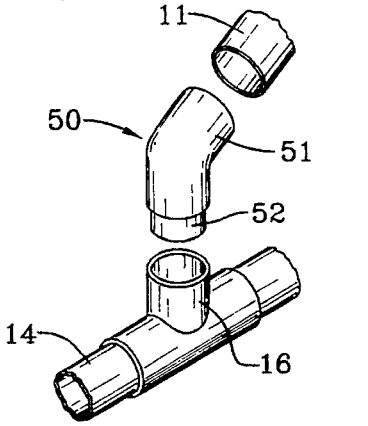
FIG. 4 is a partially exploded perspective view of an angular coupling at the bottom of the vertical support.

FIG. 4 shows an optional angular fitting 50 that can be inserted between the tee fitting 16 and target vertical support 11 to position the netting or panels at an angle with the horizontal supporting surface. The angular fitting can face either forward or backward. The angular fitting 50 has an angular section 51 with one end 52 of reduced diameter that can be press-fit into tee fitting 16, and a second end that can have the target vertical support 11 press-fit into it.

Figure 5:
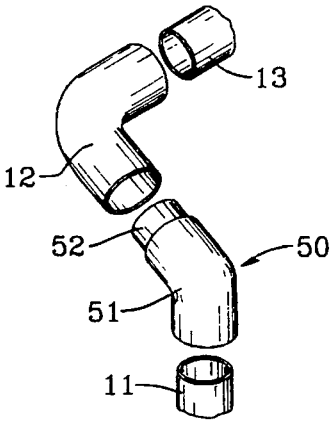
FIG. 5 is an exploded perspective view of an angular coupling at the top of the vertical support.

FIG. 5 is a view similar to FIG. 4 showing the angular fitting 50 placed on the top of vertical support 11 and facing forward so as to connect the horizontal transverse upper support 13 forward of the vertical support 11. If desired, an extension can be provided between the angular fitting 50 and the 90 degree fitting 12 secured to the horizontal transverse upper support. In this configuration the top portion of the front and rear panels 2,3 are angled forward with respect to the horizontal support surface. Because the trajectory of a ball is usually upward at the time it reaches the panels of the practice target, this configuration increases the effective height of the panels.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A portable ball practice target including:

a framework having a base support and an essentially vertical support extending above said base support;

a target front panel and a target back panel attached along three sides with one side unattached;

said target front panel and said target back panels fitting over said framework vertical support like a sock or pillowcase.

2. A portable ball practice target as described in claim 1 wherein:

said target front panel has a centrally located pocket and said target rear panel has a centrally located opening;

said target front panel pocket is threaded through said target rear panel opening.

3. A portable ball practice target as described in claim 1 wherein:

said target front panel and said target rear panel are in the form of open mesh netting.

4. A portable ball practice target as described in claim 1 wherein:

said framework includes pipes and fittings of a light-weight hollow plastic material with select sections of said framework press fit together.

5. A portable ball practice target as described in claim 4 wherein:

said framework base support includes a material within said framework base support to increase stability of said practice target during use.

6. A portable ball practice target as described in claim 3 wherein:

said target front panel is a resilient material that repels and returns balls that strike it.

7. A portable ball practice target as described in claim 1 wherein:

said essentially vertical support extending above said base support includes vertical supports and a transverse upper horizontal support with said vertical supports and said transverse upper horizontal support having angular couplings inbetween to position said transverse upper horizontal support in front of said vertical supports.

8. A portable ball practice target as described in claim 2 wherein:

said front panel is provided with adjustable horizontal and vertical strips that form an adjustable target area and adjust the size of said pocket opening.

9. A portable ball practice target as described in claim 1 wherein:

said target framework base support and said essentially vertical support are attached together by angular fittings to position said essentially vertical support at an angle with said target framework base and a horizontal supporting surface.

10. A portable ball practice target as described in claim 1 wherein:

said target base support has a front transverse support;

a ball support fitting is provided near the center of said front transverse support;

said ball support fitting joins said front transverse support to a ball support means positioned in front of said ball practice target.

11. A portable ball practice target as described in claim 10 wherein:

said ball supporting means includes a vertical pipe and a resilient tube telescopically fit together to support a ball at a user selected height.

12. A portable ball practice target as described in claim 1 wherein:

said framework essentially vertical support is attached to said framework base support with adjustable couplings;

said adjustable couplings permitting said framework essentially vertical support to be pivoted with respect to said framework base and a horizontal supporting surface.

13. A portable ball practice target as described in claim 12 wherein:

said adjustable coupling includes relatively rotatable disc-like extensions clamped together to fix the target essentially vertical framework in a selected angular orientation with respect to said framework base and said horizontal supporting surface.

14. A portable ball practice target including:

a target framework having a base support and an essentially vertical support extending above said base support;

a target front panel and a target rear panel supported by said framework essentially vertical support;

said target front panel having a centrally located pocket and said target rear panel having a centrally located opening;

said target front panel pocket being threaded through said target rear panel opening.

15. A portable ball practice target as described in claim 14 wherein:

said framework essentially vertical support is attached to said framework base support with adjustable couplings;

said adjustable couplings permitting said framework essentially vertical support to be pivoted with respect to said framework base and a horizontal supporting surface.

16. A portable ball practice target as described in claim 15 wherein:

said adjustable couplings include relatively rotatable disc-like extensions clamped together to fix said target essentially vertical support framework in a selected angular orientation with respect to framework base and said horizontal supporting surface.

17. A portable ball practice target as described in claim 14 wherein:

said target front panel pocket has a select depth;

said target framework base support extends back of said target vertical support a distance equal to or greater than said target front panel pocket net depth to form a visible safety zone.

18. A portable ball practice target as described in claim 14 wherein:

said front panel is provided with adjustable horizontal and vertical strips that form an adjustable target area and adjust the size of said pocket opening.

19. A portable ball practice target as described in claim 14 wherein:

said target front panel and said target rear panel are secured together along three edges with a fourth edge not secured;

said target framework is formed in sections with the intersections of the target framework being structured so as to be joined together and removed by pressing and pulling;

said target front and said target rear panel are assembled and disassembled over said target framework essentially vertical support like a pillowcase is assembled over a pillow.

20. A portable ball practice target as described in claim 14 wherein:

said target framework base support and said essentially vertical support are attached together by angular fittings to position said essentially vertical support at an angle with said target framework base and a horizontal supporting surface.

* * * * *